United States Patent [19]

Valle et al.

[11] Patent Number: 4,637,744

[45] **Date of Patent: * Jan. 20, 1987**

[54] ACTUATION DEVICE FOR TWO TYPEWRITER FUNCTIONS

[75] Inventors: Franco Valle; Pietro Musso, both of Ivrea, Italy

[73] Assignee: Ing. C. Olivetti & C., S.p.A., Ivrea, Italy

[ * ] Notice: The portion of the term of this patent subsequent to Sep. 18, 2001 has been disclaimed.

[21] Appl. No.: 516,429

[22] Filed: Jul. 22, 1983

Related U.S. Application Data

[63] Continuation of Ser. No. 252,416, Apr. 9, 1981, Pat. No. 4,472,073.

[30] Foreign Application Priority Data

Apr. 15, 1980 [IT] Italy ..... 67581 A/80

[51] Int. Cl.[4] ..... B41J 5/30

[52] U.S. Cl. ..... 400/185; 400/208; 400/212; 400/214; 400/216; 400/216.1; 400/696; 400/697.1

[58] Field of Search ..... 400/56, 144.2, 154.4, 400/162.3, 185, 186, 187, 196.1, 200, 206.1, 206.2, 206.3, 206.4, 207, 208, 212, 213, 213.1, 214, 216, 216.1, 216.4, 229, 323, 696, 697, 697.1

[56] References Cited

U.S. PATENT DOCUMENTS

| | | | |
|---|---|---|---|
| 3,268,049 | 8/1966 | Krauss et al. | 400/186 |
| 3,366,214 | 1/1968 | Tutert et al. | 400/154.4 X |
| 3,707,214 | 12/1972 | Ponzano | 400/144.2 |
| 3,858,702 | 1/1975 | Azuma | 400/323 X |
| 3,863,749 | 2/1975 | Perry et al. | 400/208 |
| 3,904,017 | 9/1975 | Frechette | 400/208 X |
| 3,905,465 | 9/1975 | Frechette et al. | 400/208 X |
| 3,983,985 | 10/1976 | Guerrini et al. | 400/144.2 |
| 4,010,834 | 3/1977 | Linder | 400/56 |
| 4,010,839 | 3/1977 | Guerrini et al. | 400/208 X |
| 4,036,348 | 7/1977 | Guerrini | 400/144.2 |
| 4,203,676 | 5/1980 | Hatsell | 400/208 |
| 4,247,210 | 1/1981 | Kacmarcik et al. | 400/208 X |
| 4,302,118 | 11/1981 | Schaefer | 400/208 |
| 4,472,073 | 9/1984 | Valle et al. | 400/185 |

FOREIGN PATENT DOCUMENTS

| | | | |
|---|---|---|---|
| 1161915 | 1/1964 | Fed. Rep. of Germany | 400/216 |
| 2146595 | 3/1973 | Fed. Rep. of Germany | 400/216.1 |
| 2322071 | 5/1973 | Fed. Rep. of Germany . | |
| 2328443 | 12/1973 | Fed. Rep. of Germany | 400/196.1 |
| 2362697 | 6/1975 | Fed. Rep. of Germany | 400/216.1 |
| 2743256 | 9/1977 | Fed. Rep. of Germany . | |
| 2030076 | 4/1980 | United Kingdom | 400/208 |
| 2031626 | 4/1980 | United Kingdom | 400/697.1 |
| 2057976 | 4/1981 | United Kingdom | 400/697.1 |

OTHER PUBLICATIONS

IBM Technical Disclosure Bulletin, "Initiating Two Independent Functions with One Actuator", Abell, Jr., vol. 20, No. 11B Apr. 1978, pp. 4856–4857.

IBM Technical Disclosure Bulletin, "Multicolor Matrix Impact Printer", Meier, vol. 21, No. 11, Apr. 1979, pp. 4448–4451.

*Primary Examiner*—Ernest T. Wright, Jr.

*Attorney, Agent, or Firm*—Banner, Birch, McKie & Beckett

[57] ABSTRACT

A cartridge for a typing ribbon and spools for a correcting ribbon are mounted on a common frame which can tilt about a spindle. In a lowered position of the frame the typing line behind a daisy wheel is visible. The frame is raised by a first stroke to the position shown to dispose the typing ribbon over the typing point on the platen. A longer stroke raises the correcting ribbon to the typing point and this longer stroke also actuates an automatic ratchet wheel and pawl type of feed mechanism for the correcting ribbon. The two strokes of the frame are controlled by a disc comprising two cam tracks with a common part and separate parts having different degrees of eccentricity relative to the common part. The grooved cam tracks are so shaped that a follower pin on an arm depending from the frame enters the radially inner track when the disc is rotated clockwise by a reversible electric motor, thereby to raise the frame by the smaller amount, whereas it enters the radially outer track in the case of anticlockwise rotation. The disc also carries a frontal cam which operates a ribbon feed mechanism for the ribbon in a container of the cartridge.

13 Claims, 13 Drawing Figures

ACTUATION DEVICE FOR TWO TYPEWRITER FUNCTIONS

This application is a continuation of application Ser. No. 252,416, filed Apr. 9, 1981, now U.S. Pat. No. 4,472,073 issued Sept. 18, 1984.

BACKGROUND OF THE INVENTION

This invention relates to an actuation device for two functions of a typewriter, which may in particular be of the electronically controlled type.

An actuation device for electric typewriters is known in which a cam actuated by a clutch is disposed on a drive shaft. The cam is arranged to cooperate cyclically with one or more cam follower levers in order to position a corresponding mechanism or linkage which controls a function of the typewriter individual thereto. On depressing the key corresponding to a function, for example back-space, the corresponding clutch closes, whereby the corresponding cam begins to rotate through one cycle, and the cam follower lever is suitably connected to the mechanism to be actuated, in this case the back-space mechanism. This actuation device is extremely costly due to the large number of parts necessary for selecting the various functions.

SUMMARY OF THE INVENTION

One object of the present invention is to provide an actuation device for at least two functions which is of low cost, reliable and very easy to use.

This object is attained by the device of the present invention, which comprises a single control member which executes cyclic movements to select the functions and selects one or the other function depending on the sense of the cycle of movement.

In typewriters, in particular in those comprising a correcting mechanism, numerous functions related to the selection, raising and feeding of the two ribbons have to be executed.

In a known device of this latter type, a first electromagnet raises a frame carrying a cartridge containing a typing ribbon for typing the characters, a second electromagnet raises the frame through a larger path of travel in order to position a correcting ribbon in front of the typing point, and a rotating electromagnet automatically feeds the typing ribbon unidirectionally after each character has been printed. This device is fast and reliable, but is very costly.

Another object of the present invention is to provide an actuation device for raising and feeding a typing ribbon and for selecting a correcting ribbon which uses few parts and which is reliable and of low cost.

This object is attained by the typing and/or correcting device according to the invention, which comprises a platen defining a printing point, a typing ribbon, an erasing ribbon and a support frame for the typing ribbon and for the erasing ribbon disposed at a different height from the typing ribbon and in which the frame can swivel to give visibility and to allow typing of characters, and a control member which effects different cyclic movements in positioning the two ribbons respectively over the typing point, and which also effects the feed movement of the typing ribbon.

BRIEF DESCRIPTION OF THE DRAWING

The invention will be described in more detail, by way of example, with reference to the accompanying drawing, in which.

DESCRIPTION OF A PREFERRED EMBODIMENT

In the embodiment described hereinafter, the two function actuation device according to the invention is applied in its various combinations for selecting, raising and feeding a typing and/or a correcting ribbon of the typewriter.

Figure 1:
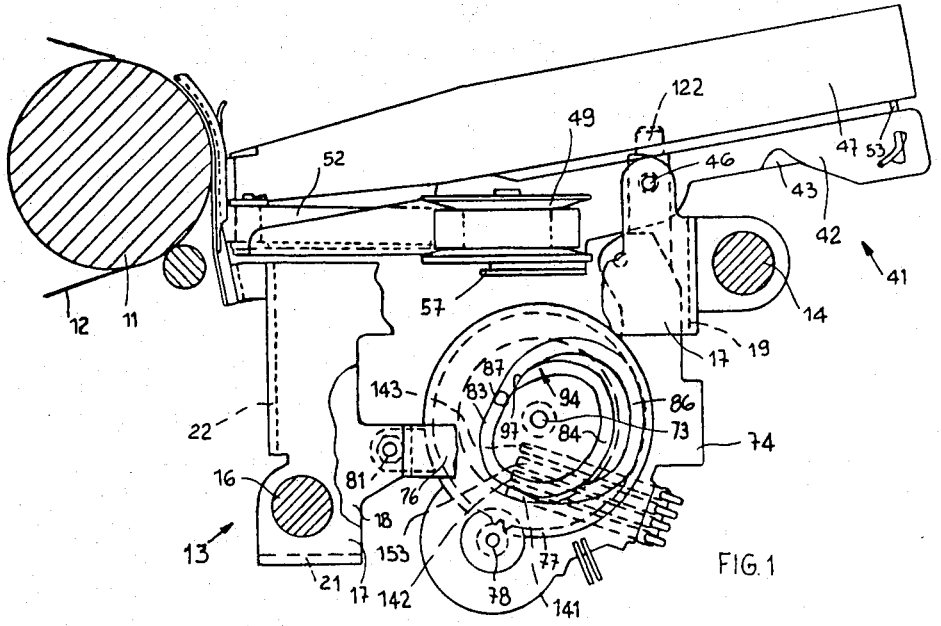
FIG. 1 is a first partial longitudinal section through a typewriter.
Figure 2:
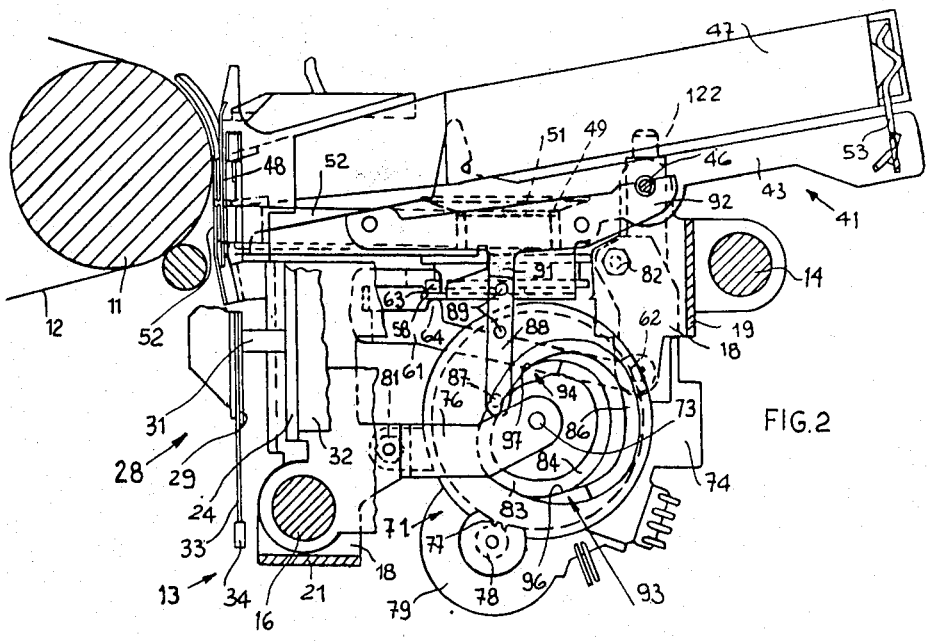
FIG. 2 is a second partial longitudinal section through the typewriter of FIG. 1.
Figure 3:
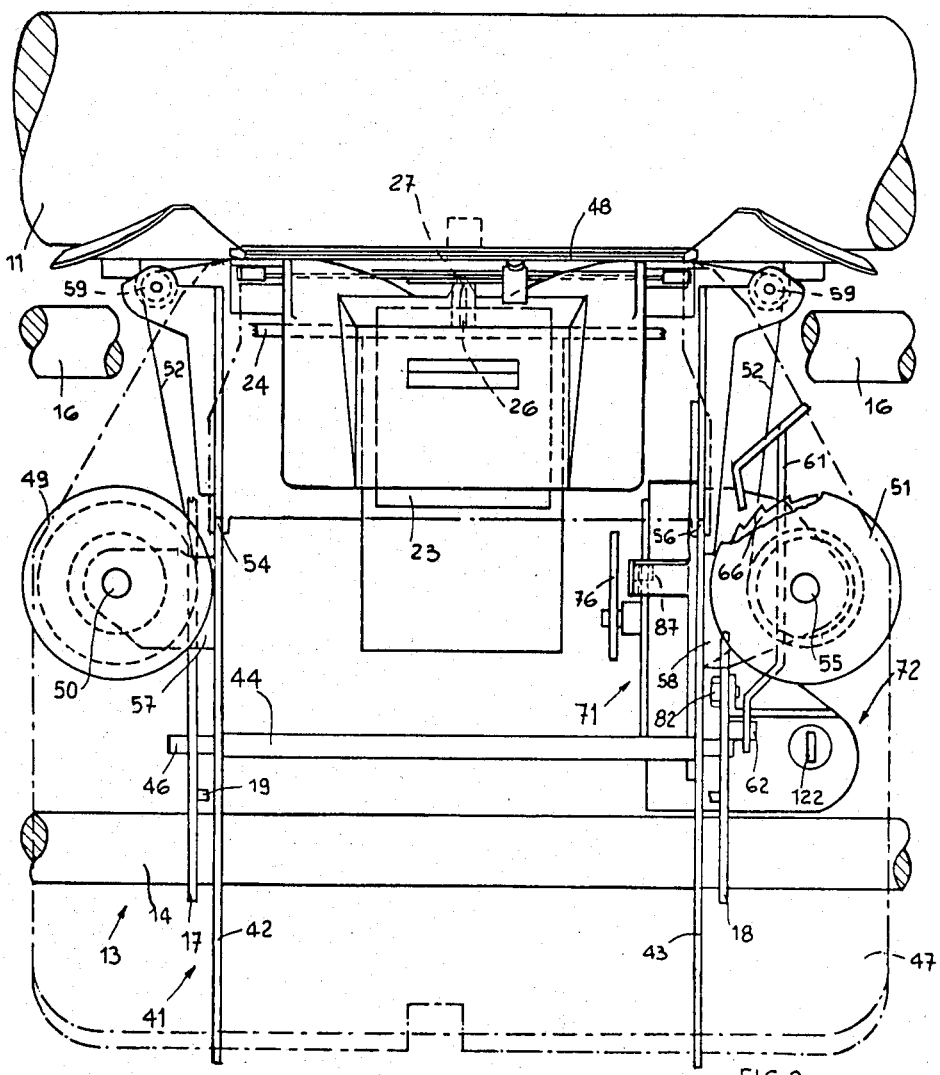
FIG. 3 is a partial plan view of the typewriter.

The typewriter comprises a normal typing paper support platen 11 (FIG. 1), on which a typing sheet 12 rests, and a carriage 13 which is movable transversely relative to the typing sheet 12 along two guides 14 and 16. The carriage 13 is slidable on the guides 14 and 16 in both directions, for example driven by a reversible electric stepping motor, not shown but as described in U.S. Pat. No. 3,707,214 assigned to Ing. C. Olivetti & C., S.p.A. The carriage 13 is constituted by side pieces 17 and 18 connected by cross plates 19, 21 and 22. An electromagnet 23 (FIG. 3) fixed to an upright 24 pivoted on the guide 16 carries a hammer 26 having an end 27 shaped in order to cooperate with a type wheel 28 (FIG. 2).

The type wheel 28 (daisy-wheel) is constructed of plastics material and is fixed to a flange 29 of a character selection shaft 31 by means of a removable connection, not shown but as described in U.S. Pat. No. 4,036,348 assigned to Ing. C. Olivetti & C., S.p.A. The character selection shaft 31 is rotatable by means of an electric motor 32 fixed to the upright 24. The type wheel 28 is radially slotted so that flexible tongues 33 (petals) are formed. Each tongue 33 carries at its end a corresponding type character 34. The type characters 34 are selected by the motor 32 in known manner, for example as described in U.S. Pat. No. 3,983,985 assigned to Ing. C. Olivetti & C., S.p.A.

A frame 41 (FIG. 3) is mounted on the carriage 13, and comprises two side plates 42 and 43 rigid with a sleeve 44 by which the frame 41 is pivoted on an axle 46 of the carriage 13. The frame 41 supports a cartridge 47 for a typing ribbon 48, and two spools, namely a feed spool 49 and a take-up spool 51, on which a correcting or erasing ribbon 52 is wound. The cartridge 47 for the typing ribbon 48 is substantially the same as that described in U.S. Pat. No. 4,010,839 assigned to Ing. C. Olivetti & C., S.p.A. and is therefore not shown in detail in the drawing. The cartridge 47 is mounted on the frame 41, and is held removably fixed by a leaf spring 53 (FIG. 2) against two shoulders 54 (FIG. 3) and 56 projecting from the side plates 42, 43 respectively. The typing ribbon 48 can be of the carbon or correctable type, in which case the ribbon 48 is not reusable, or can be of the endless fabric type.

The feed spool 49 is rotatable on a spindle 50 carried by a lug 57 of the plate 42, while the take-up spool 51 is rotatable on a spindle 55 on a lug 58 of the plate 43. The correcting ribbon 52, which can be of the lift-off or cover-up type, is guided between the two spools 49 and 51 by means of two ribbon guides 59 so that the correcting ribbon 52 remains disposed below the typing ribbon 48 and parallel both to the ribbon 48 and to the platen 11. A pawl 61 is pivoted on a pin 62 of the side piece 18, and is guided by two shoulders 63 and 64 (FIG. 2) on the lug 58 for cooperation with a toothed wheel 66 (FIG. 3) of the take-up spool 51.

Figure 4:
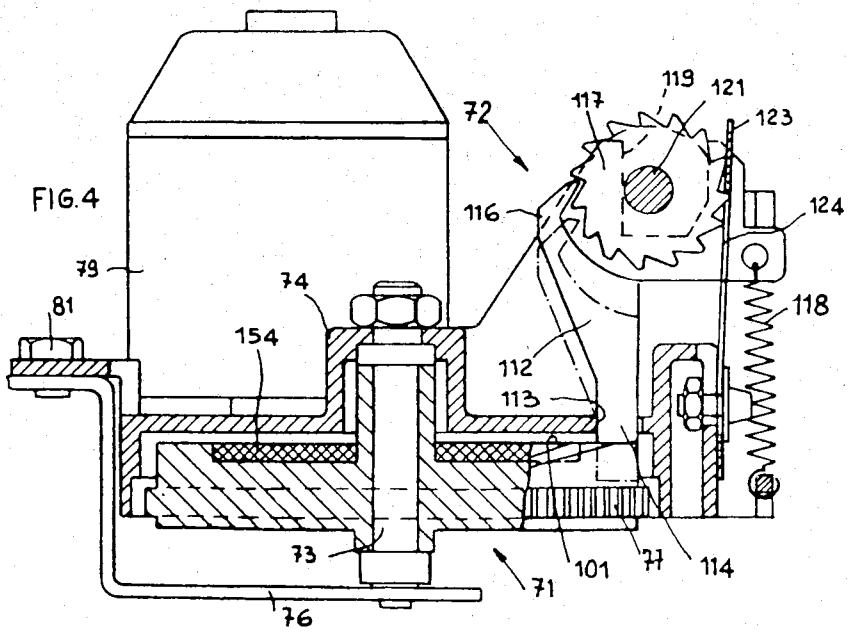
FIG. 4 is a partly sectional plan view of some details of FIG. 3.

A control device 71 raises the frame 41 to different heights in order to position either the typing ribbon 48 or the correcting ribbon 52 over the typing point, and simultaneously operates a mechanism 72 for the unidirectional feed of the ribbon 48, in order to feed the typing ribbon 48. The control device 71 (FIG. 4) is constituted by a rotatable disc with a spindle 73 supported at one end by a support cap 74 and at the other end by an arm 76 of the side piece 18 (FIG. 2). The control disc 71 comprises an outer ring gear 77 permanently engaged with a pinion 78 of an electric motor 79 arranged to rotate selectively in a clockwise or anticlockwise direction. The electric motor 79 is rigid with the support 74, which is fixed by a first screw 81 to the arm 76 of the side piece 18 and by a second screw 82 to the side piece 18.

The control disc 71 comprises a common cam track 83 connected to two eccentric cam tracks 84 and 86 so as to form two grooved cam tracks connected together by the shared track 83. The grooved tracks 84 and 86 are formed at different radial distances on one side of the control disc 71, and are arranged to receive a pin 87 of a cam follower 88.

Only one of the two tracks 84 and 86 can be engaged by the pin 87, depending on the direction of rotation of the disc 71. To prevent the pin 87 being able to engage one or other of the tracks 84 and 86 each comprise a step or shoulder 96, 97 and a ramp or inclined surface 93, 94 which can be engaged in only one direction. In the inclined surface or interconnection zone 93 (FIG. 2), the track 86 has a part in which its depth gradually reduces in order to form a shoulder or step 96 arranged to prevent passage of the pin 87. Likewise in the inclined surface or interconnection zone 94 the track 84 has a part in which its depth gradually reduces in order to form a shoulder or step 97 arranged to prevent passage of the pin 87. The cam follower 88 which carries the pin 87, normally received and guided in the common track 83, is constituted by a leaf spring 88 fixed by two riveted pins 89 to an arm 91 of a lever 92 rigid with the plate 43 of the frame 41.

Figure 7:
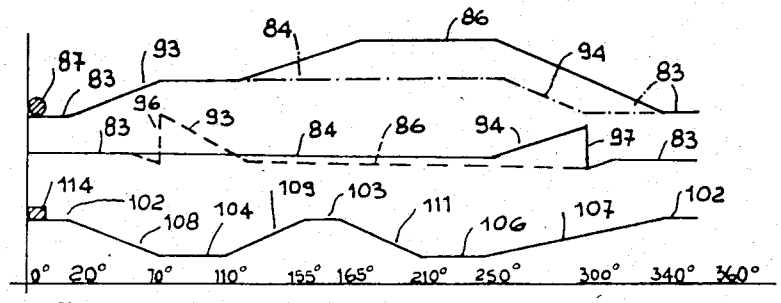
FIG. 7 shows three working diagrams of the element of FIGS. 5 and 6.
Figure 8:
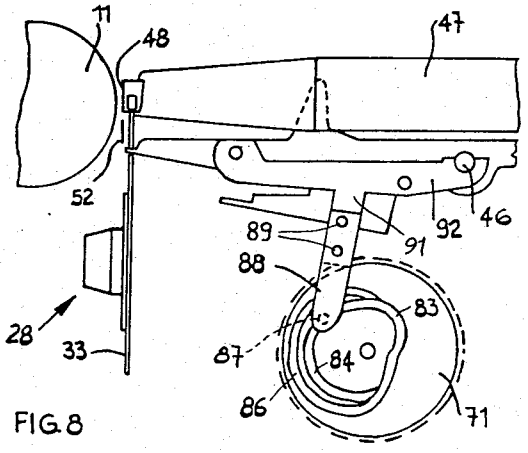
FIG. 8 is a diagrammatic longitudinal view of the typewriter as seen in FIG. 2 in a first working position.

If the motor 79 rotates the control disc 71 clockwise, the pin 87 is guided by the side walls of the common cam track 83, passes into the interconnection zone 93, and, guided by the shoulder 96, reliably engages the eccentric track 84, which moves it upwards together with the spring 88, the arm 91, the lever 92 and the plates 42 and 43, to cause the frame 41 to rotate clockwise about the axle 46 and dispose it in a typing position with the typing ribbon 48 in front of the typing point, as illustrated diagrammatically in FIG. 8. As the rotation of the disc 71 continues, the track 84 (FIG. 2) brings the pin 87 on to the interconnection 2 one 94, which moves the pin 87 outwards, so bending the leaf spring 88. As soon as the pin 87 passes beyond the edge of the interconnection zone 94, the leaf spring 88 returns the pin 87 to its original position in the track 83. The pin 87 (FIG. 7), which is in the 0° position, slides through 20° in the track 83, and then slides through 50° in the interconnection zone 93, until between 70° and 250° it becomes disposed in the track 84 in which the cartridge 47 (FIG. 8) passes from a rest position giving visibility to the typed characters, to an intermediate position for typing the characters. After rotating through 90°, the disc 71 is halted to allow a character to be typed. If after a predetermined time period, as described hereinafter, a second character is not typed, the disc 71 is rotated in an anticlockwise direction and returned to its rest position at 0°. However, if rapid typing is carried out with a number of characters being struck, the disc 71 is rotated and halted at 230° (FIG. 7) to allow typing of a further character, and is then rotated and halted at 90° and so on. Because of this the cartridge 47 (FIG. 8) always remains in the intermediate position for character typing. If the disc 71 is in the 230° position (FIG. 7) and no further characters are typed, after the predetermined time period the disc 71 is rotated clockwise so that the pin 87 passes from 250° to 300° guided by the interconnection zone 94, and then from 300° to 360° guided by the track 83.

If the motor 79 (FIG. 2) rotates the control disc 71 in an anticlockwise direction, the pin 87 is guided by the side walls of the common track 83, passes into the interconnection zone 94 and, guided by the shoulder 97, engages the eccentric track 86 which moves it upwards together with the spring 88, the arm 91, the lever 92 and the plates 42 and 43, to cause the frame 41 to rotate clockwise about the axle 46 through an angle greater than that determined by the track 84. The frame 41 thus becomes disposed in the correcting position, with the correcting ribbon 52 in front of the typing point as shown diagrammatically in FIG. 9. As the disc 71 continues to rotate, the track 86 (FIG. 2) moves the pin 87 to the interconnection zone 93, which moves the pin 87 outwards so bending the leaf spring 88. As soon as the pin 87 passes beyond the edge of the interconnection zone 93, the spring 88 returns the pin 87 into its original position. The pin 87 (FIG. 7), which starts in the 0°=360° position, moves from 360° by rotating the disc 71 in an anticlockwise direction, and sliding in the track 83 becomes disposed from 250° to 180° in the track 86 in which the cartridge 47 (FIG. 9) passes from the rest position to the high position in order to position the correcting ribbon 52 in front of the typing point. During this raising movement, the pawl 61 (FIG. 3) engages a tooth of the toothed wheel 66 to rotate the take-up spool 51 in an anticlockwise direction, thus feeding the correcting ribbon 52. When the correcting ribbon 52 is positioned in front of the typing point, the disc 71 (FIG. 2) is halted and the erasing stroke is carried out, as described hereinafter. The disc 71 is then rotated from 180° to 0° to bring the pin 87 into engagement with the interconnection zone 93 and track 83. It is apparent that the grooved tracks 83, 84 and 86 always control the pin 87 positively, so preventing oscillation during typing or erasing of the characters with respect to the typing point.

Figure 6:
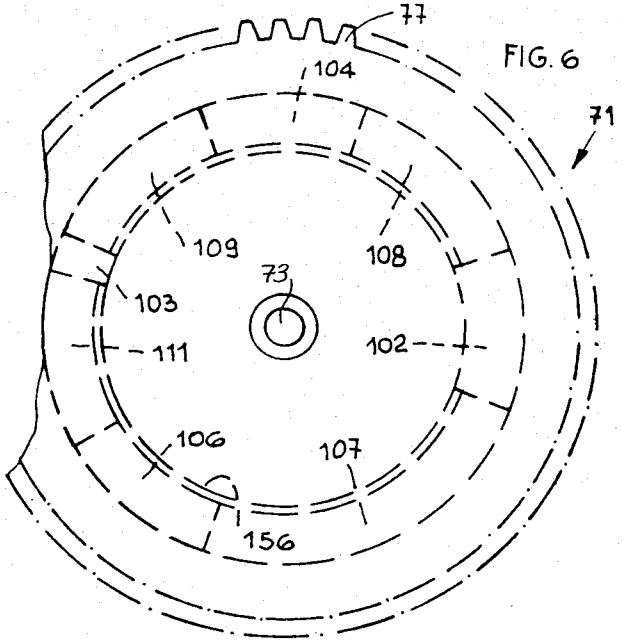
FIG. 6 is a partial plan view of the element of FIG. 5.
Figure 5:
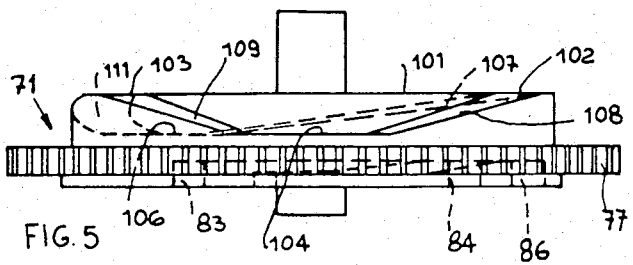
FIG. 5 is a side view of an element of FIG. 4 to an enlarged scale.

The control disc 71 (FIG. 5) comprises a frontal cam 101 disposed on the opposite side to the grooved tracks 83, 84 and 86, and arranged to control the mechanism 72 (FIG. 4) for the automatic unidirectional feed of the typing ribbon 48. The frontal cam 101 (FIGS. 5 and 6) comprises two upper lobes 102 and 103 and two lower lobes 104 and 106 connected together by four inclined surfaces 107, 108, 109 and 111, in order to actuate the mechanism (FIG. 4) twice for each 360° rotation of the disc 71. The mechanism 72 comprises a pawl 112 guided in a slot 113 of the support 74 and comprising a lug 114 arranged to cooperate with the frontal cam 101, and a tooth 116 for operating a toothed wheel 117. A spring 118 holds the pawl 112 with the lug 114 against the frontal cam 101 and with a shoulder 119 against a shaft 121. The toothed wheel 117 is rigid with the shaft 121, which is connected to a blade 122 (FIG. 2) engaged with a sleeve, not shown but similar to that described in the aforesaid U.S. Pat. No. 4,010,834 for the unidirectional feed of the typing ribbon 48 in the zone adjacent to the swivel axle 46 of the cartridge 47. A leaf spring 123 (FIG. 4) fixed to the support 74 has a slot 124 arranged to cooperate with a tooth of the toothed wheel 117 in order to prevent back running of the toothed wheel 117. During the clockwise rotation of the disc 71, as heretofore described, for moving the cartridge 47 (FIG. 2) from its rest position in which the written characters are visible to its intermediate position for character typing, the lug 114 (FIG. 7), engaged with the upper lobe 102, slides from 0° to 20° on the lobe 102 and then until 70° on the inclined surface 108, to engage the lower lobe 104 from 70° to 110°, and the pawl 112 (FIG. 4) passes from the position shown by the continuous line to that shown by the dashed and dotted line under the action of the spring 118. If the disc 71 is returned to rest in the 0° position, the lug 114 (FIG. 7) engages the inclined surface 108 and then the upper lobe 102. The pawl 112 (FIG. 4) is raised against the action of the spring 118, the tooth 116 engages a tooth of the toothed wheel 117 to cause it to rotate in the clockwise direction together with the shaft 121, and thus feed the typing ribbon 48. However, if the disc 71 is rotated clockwise, the lug 114 (FIG. 7) passes from the 70°–110° position on the lower lobe 104 and by way of the 110°–155° position on the inclined surface 109 to the 116°–165° position on the upper lobe 103, to actuate the feed of the typing ribbon 48 as heretofore described. If rapid typing is under way, the lug 114 slides from the 250° position to the 70° position, and then again to the 250° position and so on. The pawl 112 (FIG. 4) is moved forwards and backwards, actuating the toothed wheel 117 to feed the typing ribbon 48. When the lug 114 (FIG. 7) is engaged with the lower lobe 106 and the disc 71 (FIG. 4) is returned to rest, the lug 114 (FIG. 7) passes from the 210°–250° position on the lower lobe 106, by way of the 250°–360° position on the upper lobe 102, so causing the typing ribbon 48 to be fed through one step.

Figure 11:
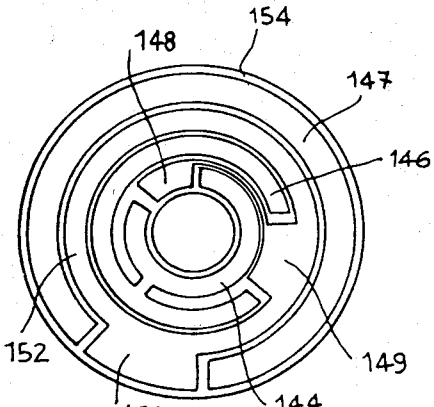
FIG. 11 is a plan view of another element of FIG. 4.
Figure 10:
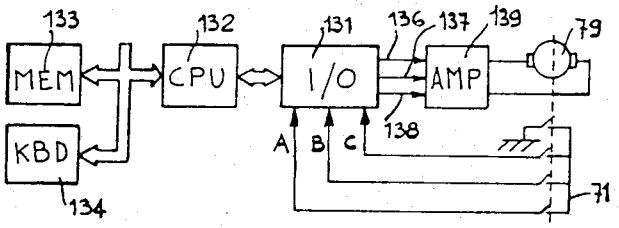
FIG. 10 is a logic block diagram of a control unit for the typewriter.

The typing and correcting device heretofore described is fitted to a machine of the type described in our published British patent application No. 2 031 626, comprising an input and output unit 131 (FIG. 10) controlled by a central processing unit 132 connected to memory 133 and to a keyboard 134. The input and output unit 131 controls the clockwise and anticlockwise rotations and the stoppage of the motor 79 by way of three lines 136, 137 and 138 and an amplifier 139, and receives the data for positioning the control disc 71 by way of three strobe signals A, B and C. These signals A, B, and C are generated by brushes 141 (FIG. 1), 142 and 143 sliding on three corresponding tracks 144 (FIG. 11), 146 and 147 having parts 148, 149 and 151 connected to a common track 152 in constant contact with a brush 153 (FIG. 1). The tracks 144 (FIG. 11) 146, 147 and 152 are carried by an insulating support 154 fixed in a seat 156 (FIG. 6) of the control disc 71. The control disc 71 can assume three reference positions, 0°, 90° and 230°, determined by the slow typing, rapid typing and correction state of the device as heretofore described.

On switching on the typewriter, the motor 79 (FIG. 10) is operated in order to move the disc 71 into the reference position indicated by 0°, and also carry out a feed operation on the typing ribbon 48 in order to put it under tension. The disc 71 can lie either in a position in which at least one of the strobe signals A, B, C is high, or in a position in which all the strobe signals A, B, C are low. If the strobe signal A is high, the central processing unit 132 activates the motor 79 by way of the line 136, to rotate it clockwise until the disc 71 has been moved into the 0° position. The ribbon feed takes place between 250° and 340° (FIG. 7) as heretofore described. If however the strobe signal B is high, the unit 132 rotates the motor 79 by way of the line 137 in an anticlockwise direction to move it into the 0° position. The ribbon feed takes place between 70° (FIG. 7) and 20°. Finally, if the strobe signal C is high, the unit 132 activates the line 136 in order to carry out the clockwise rotation which moves the disc 71 into the 90° position. Immediately afterwards, it causes the motor 79 to return to the 0° position, so feeding the typing ribbon 48 between 70° and 20°. In all cases, braking is controlled by the front of the strobe signal C and lasts for a predetermined time of about 10 ms.

If the strobe signal A, B, C are all low, the unit 132 causes the motor 79 to rotate clockwise for a time of 15 ms without exploring the strobe signal A, B or C. After this time expires, the motor 79 continues to rotate until any strobe signal A, B, C becomes high, after which it is brakekd under countercurrent. At the end of the movement, the device is therefore in proximity to one of the reference positions, and one of the strobe signals A, B, C is high. At this point, the disc 71 is positioned in the manner described heretofore, until it is brought into its 0° position.

Figure 12:
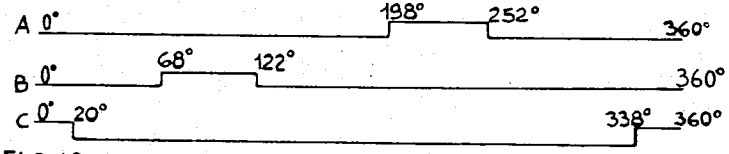
FIG. 12 represents three working diagrams of the element of FIG. 11.

If a certain number of characters has been typed on the keyboard 134, the central processing unit 132 controls the motor 79 to execute a clockwise rotation of the disc 71 until the strobe signal B becomes high at 68° (FIG. 12). Starting from this moment, the voltage across the motor 79 is reversed for 10 ms, in order to halt the device in proximity to the 90° position, and raise the typing ribbon 48 and re-cock the corresponding feed device 72 as heretofore described. The striking command can be given at the end of the countercurrent time.

If during the next 150 ms, no other character is typed, the central processing unit 132 causes the device to return to the 0° position. Voltage is then fed to the motor 79 until the rise in the strobe signal C (at 20°). In this case, the typing ribbon 48 is fed and lowered. If however a further character is typed, the central processing unit 132 causes the motor 79 to rotate from 90° to 230° (or vice versa), and the typing ribbon 48 always remains high, the ribbon feed begins at 110° and ends at 165°. With the rise in the strobe signal A at 198° (FIG. 12), a braking operation is commenced, and the striking operation is activated, at the end of which the device is ready to carry out a further movement. If rapid typing is to be continued, the reverse movement (from 230° to 90°) is carried out. In this case, the typing ribbon feed takes place between 210° and 155°. The significant strobe signal is B (at 122°), which controls the new braking operation and authorises the striking.

Figure 9:
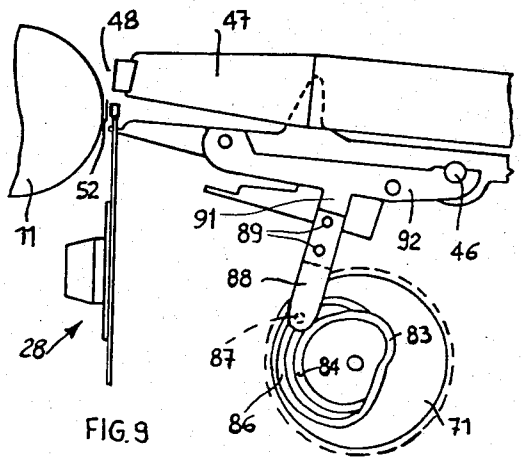
FIG. 9 is another diagrammatic view of the typewriter of FIG. 8 in a second working position.

If it is required to correct the last character typed, the device must be brought into the 0° position, and the disc 71 (FIG. 10) then moved in an anticlockwise direction from 360° to 230°, thus causing the correcting ribbon 52 to rise and be fed between 340° (FIG. 7) and 250°. The strobe signal A (FIG. 12) provides the significant front at 252° for braking, at the end of which authorization is given for the erasing command (as shown in FIG. 9). When erasing has taken place, the central processing unit 132 causes a reverse rotation from 230° to 360°, with braking of 10 ms starting from the change-over of the strobe signal C at 338° (FIG. 12). With this movement, the erasing ribbon 52 is lowered, and the typing ribbon feed device is re-cocked between 250° and 340°. The entire cycle heretofore described is repeated from subsequent corrections.

On striking a character to replace that or those erased, the central processing unit 132 (FIG. 10) causes the motor 79 to make a clockwise rotation of the disc 71 until the strobe signal B is high at 68° (FIG. 12). Starting from this moment, the voltage across the motor 79 (FIG. 10) is reversed for 10 ms in order to stop the device in proximity to the 90° position. The typing ribbon 48 is raised, the feed device is re-cocked and the striking command is given at the end of the countercurrent time.

Figure 13:
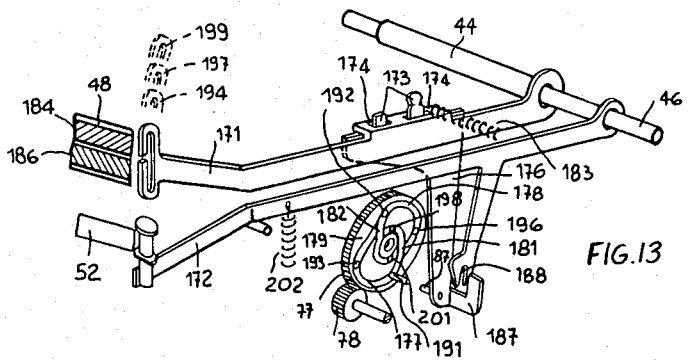
FIG. 13 is a perspective view of a modification of FIGS. 1 and 2.

Various modifications can be made to the device heretofore described within the scope of the invention. For example, the frame 41 on which the cartridge 47 (FIG. 2) is mounted can be immobile. The typing ribbon 48 and correcting ribbon 52 are then each guided towards the typing point by two ribbon guide levers 171 (FIG. 13) and 172 respectively (only one lever 171 and 172 is visible in FIG. 13), pivoted on the axle 46. The lever 171 is connected by lugs 173 and slots 174 to a lever 176 which at its end has the pin 87 housed in two tracks 177 and 178 of a control member or disc 179 similar to the control member 71 (FIG. 2). The control disc 179 (FIG. 13) comprises a ring gear 77 engaged with the pinion 78 of the electric motor 79 (FIG. 2). The intersection zones 181 (FIG. 13) and 182 of the tracks 177 and 178 are similar to the interconnection zones 93 (FIG. 2) and 94 of the tracks 84 and 86, so that the lever 176 (FIG. 13) is held by a spring 183 with its pin 87 against the base of the tracks 177 and 178. The typing ribbon 48 has two typing zones 184 and 186 in order to utilise the entire height of the ribbon 48. The lever 176 comprises a lug 187 arranged to cooperate with a fork 188 of the ribbon guide lever 172 for the correcting ribbon 52. The pin 87 can be positioned either in the position 191 or in the position 192, as they are symmetrical.

If the pinion 78 rotates the control disc 179 in an anticlockwise direction, it moves the pin 87 from the position 191 to a position 193 in which the lug 187 does not engage the fork 188, and the levers 171 are positioned in the low position indicated by 194, with the zone 184 of the ribbon 48 in front of the typing point. The characters are struck, and then the control disc 179 is disposed in the position 192. The disc 179 continues to rotate in an anticlockwise direction, and moves the pin 87 from the position 192 to the position 196 in which the lug 187 does not engage the fork 188, and the levers 171 are positioned in the intermediate position indicated by 197, with the second zone 186 in front of the typing point. After the striking of the characters, the disc 179 is positioned in the position 191.

If an erasing operation is to be carried out, the disc 179 is rotated clockwise so that the pin 87 passes from the position 191 to a position 198 in which the lug 187 engages the fork 188 and raises the levers 171 and 172. The levers 171 are positioned in the high position indicated by 199, with the correcting ribbon 52 in front of the typing point. After the erasing, the member 179 returns the pin 87 into the position 191, and a spring 202 returns the correcting ribbon guide levers 172 to rest. An analogous operation takes place if the pin 87 is in the position 192, in that it becomes positioned in the position 201 symmetrical to the position 198, and is then returned to rest in the position 192.

In a further modification of the device heretofore described, the electric motor 79 and the position indicating disc 154 can be replaced by a single stepping motor. Moreover, the control disc 71 can be used in order to actuate any other function of an electrical or electronic typewriter, such as spacing between lines, carriage feed, back-space return, carriage return, half back-space etc. The modifications to be made to the grooved tracks 83, 84 and 86 and to the controls for the aforesaid functions can be easily determined by one skilled in the art on the basis of the foregoing explanations.

We claim:

1. In a typing machine comprising a platen including a typing point, a typing ribbon, typing ribbon feed means actuatable for feeding said typing ribbon, a correcting ribbon, a supporting frame for supporting the correcting ribbon, and lift means actuatable for moving the supporting frame between an inoperative position and an operative position, wherein the correcting ribbon is away from the typing point when the supporting frame is in said inoperative position and wherein the correcting ribbon is in front of the typing point for correction of a printed character where the supporting frame is in said operative position, the combination comprising:

a reversible motor having a rotatable motor member, means controlling said reversible motor for causing said rotatable motor member to execute bidirectional cyclic rotations, first means responsive to a cyclic rotation of said rotatable motor member for actuating said typing ribbon feed means, and second means responsive to a unidirectional cyclic rotation of said rotatable motor member according to a given sense of rotation for actuating said lift means, and wherein said second means remain inoperative over said supporting frame upon cyclic rotations of said rotatable motor member opposite to the given sense of rotation of said rotatable motor member.

2. A typing machine according to claim 1, wherein said first means comprise typing ribbon cam means operated by said rotatable motor member and a typing ribbon cam follower means cooperative with said typing ribbon cam means, wherein said typing ribbon feed means comprise a toothed wheel having a feed element for the feeding of the typing ribbon and a pawl cooperative with said toothed wheel, and wherein said pawl is operated by the typing ribbon cam follower means upon a cyclic rotation of said rotatable motor member.

3. A typing machine according to claim 1, wherein said second means comprise correcting cam means rotated by said rotatable motor member and correcting cam follower means operative on said supporting frame.

4. A typing machine according to claim 1, further comprising position indicator means having a part rotated by said rotatable motor member and generating a rest position signal associated with a given position of said rotatable motor member and wherein said means controlling said reversible motor respond to said rest position signal to arrest said rotatable motor member on a rest position associated with the inoperative position of said supporting frame.

5. A typing machine according to claim 1 further comprising position indicator means having a part rotated by said rotatable motor member and generating a correction position signal associated with a given position of said rotatable motor member, and wherein said means controlling said reversible motor respond to said correction position signal to arrest said rotatable motor member on a correcting position associated with the operative position of said supporting frame.

6. A typing machine according to claim 1, wherein said means controlling said reversible motor comprise a position indicator arranged to feed position signals associated with the inoperative position and the operative position.

7. A typing machine according to claim 1, further comprising correcting ribbon feed means responsive to the movement of said supporting frame between said inoperative position and said operative position for feeding said correcting ribbon.

8. A typing machine according to claim 1, wherein the characters to be printed are carried by a daisy wheel.

9. A typing machine according to claim 1, wherein the typing ribbon is carried by a cartridge.

10. In a typing machine comprising a platen defining a typing point; a typing ribbon cartridge containing a typing ribbon; typing ribbon feed means comprising a rotatable feed cam and a feed cam follower cooperative with said feed cam for feeding the typing ribbon of said cartridge; a correcting ribbon; a supporting frame for supporting the ribbon cartridge and the correcting ribbon, wherein said typing ribbon and the correcting ribbon each have an operative portion; lift control means comprising a rotatable lift cam and a lift cam follower cooperative with said lift cam for moving the supporting frame between an inoperative position, a typing position and a correcting position, wherein the operative portion of the typing ribbon and the correcting ribbon are away from the typing point in the inoperative position of the supporting frame, for visibility, and wherein the operative portion of the typing ribbon is in front of the typing point for the typing of a character and the operative portion of the correcting ribbon is in front of the typing point for correction of a printed character in the typing position and in the correcting position of the supporting frame, respectively; a reversible motor; and controlling means controlling the reversible motor to execute bidirectional rotations including position indicator means having a part rotated by the reversible motor and which can generate a rest position signal associated with a rest position of the lift cam and the feed cam, a typing position signal associated with a typing position of said lift cam and said feed cam and a correcting position signal of said lift cam and said feed cam, wherein said lift cam comprises a low lift profile between the rest position and the typing position along one sense of rotation of said lift cam and said feed cam and a high lift profile between the rest position and the typing position along one sense of rotation of said lift cam and said feed cam and a high lift profile between the rest position and the correcting position along the other sense of rotation opposite to said one sense of rotation of said lift cam and said feed cam and wherein said feed cam comprises an active profile between the rest position and the typing position of said feed cam, wherein the controlling means respond to the rest position signal to arrest the reversible motor on a rest position associated with the inoperative position of the supporting frame, wherein said controlling means control said reversible motor for a typing cycle providing rotation of said lift cam and feed cam along said one sense of rotation from said rest position to said typing position up to receive said typing position signal, and return to the rest position along the opposite sense of rotation so that said low lift profile causes the lift cam follower to position the supporting frame in the typing position for enabling the typing of the character and the return of the supporting frame to the rest position and wherein the active portion of said feed cam causes the typing ribbon to be fed through a step, and wherein said controlling means control said reversible motor for a correcting cycle providing rotation of said lift cam along the opposite sense of rotation from said rest position up to receive said correcting position signal so that said high lift profile causes the lift cam follower to position the supporting frame in the correction position for enabling the correction of a printed character and wherein said controlling means causes a following rotation of the lift cam up to receive said rest position signal whereby returning said supporting frame to said rest position.

11. A typing device according to claim 10, wherein said lift cam comprises a common cam track and two cam tracks configurated to be followed by said lift cam follower depending on the sense of rotation of said lift cam, wherein said common cam track is followed by said lift cam follower in the rest position of said lift cam, wherein said low lift profile is included in one of said two cam tracks and wherein said high lift profile is included in the other of said two cam tracks.

12. A typing device according to claim 11, wherein each of said two cam tracks includes an inclined surface and a stepped surface adjacent to the common cam track, wherein the lift cam follower in movably supported and urged by a spring to follow the inclined surface and to unidirectionally pass through the stepped surface of the two cam tracks, wherein the cam follower follows the inclined surface of one cam track, is arrested by the stepped surface of the other cam track and returns to the common cam track through the stepped surface of said one cam track in response to a complete rotation along said one sense of rotation of said lift cam and wherein the lift cam follower follows the inclined surface of the other cam track, is arrested by the stepped surface of the one cam track and returns to the common cam track through the stepped surface of the other cam track in response to a complete rotation of the lift cam along the other sense of rotation of said lift cam.

13. A typing device according to claim 12, wherein the following rotation of said lift cam comprises a rotation if said lift cam from said correction position to said rest position along said other sense of rotation of the lift cam.

* * * * *